US007910851B2

(12) United States Patent
Janninck et al.

(10) Patent No.: US 7,910,851 B2
(45) Date of Patent: Mar. 22, 2011

(54) PADSTACKS CAPABLE OF RECEIVING DOMES OF DOME KEYPADS IN A PLURALITY OF LOCATIONS AND PRINTED CIRCUIT BOARDS UTILIZING THE PADSTACKS

(75) Inventors: Mark D Janninck, Glen Ellyn, IL (US); Alden R Alviar, Indian Creek, IL (US); Kenneth W Carlson, Hawthorn Woods, IL (US)

(73) Assignee: Motorola Mobility, Inc., Libertyville, IL (US)

( * ) Notice: Subject to any disclaimer, the term of this patent is extended or adjusted under 35 U.S.C. 154(b) by 321 days.

(21) Appl. No.: 12/323,513

(22) Filed: Nov. 26, 2008

(65) Prior Publication Data

US 2010/0126835 A1 May 27, 2010

(51) Int. Cl.
*H01H 13/78* (2006.01)

(52) U.S. Cl. ..... 200/516; 200/5 A

(58) Field of Classification Search ..... 200/5 R, 200/5 A, 406, 512–517, 292; 341/22, 23; 345/169; 400/472, 482–489
See application file for complete search history.

(56) References Cited

U.S. PATENT DOCUMENTS

| | | | | |
|---|---|---|---|---|
| 5,128,500 | A * | 7/1992 | Hirschfeld | 200/5 R |
| 5,579,002 | A * | 11/1996 | Iggulden et al. | 341/23 |
| 5,734,137 | A * | 3/1998 | Wakefield | 200/5 A |
| 6,140,593 | A * | 10/2000 | Bramesfeld et al. | 200/5 A |
| 6,259,044 | B1 * | 7/2001 | Paratore et al. | 200/5 A |
| 6,844,508 | B2 * | 1/2005 | Lim | 200/5 A |
| 7,102,086 | B2 * | 9/2006 | Bick et al. | 200/5 A |
| 2006/0018463 | A1 | 1/2006 | Rak et al. | |
| 2006/0118400 | A1 * | 6/2006 | Chyc et al. | 200/512 |

* cited by examiner

*Primary Examiner* — Michael A Friedhofer
(74) *Attorney, Agent, or Firm* — Gary J. Cunningham

(57) ABSTRACT

Disclosed is a printed circuit board configured for a dome-utilizing keypad configuration including at least one padstack having a plurality of dome switch targets and a plurality of target rings capable of accommodating different key dome locations of a dome keypad. Also disclosed is a padstack capable of accommodating different key dome locations. The disclosed padstack has a single dome switch targets input/output line for the plurality of dome switch targets of the padstack. The padstack also includes a single target rings input/output line for the plurality of target rings of the pad stack. In this way the disclosed printed circuit board includes a single circuit arrangement available for a plurality of different key pad designs.

20 Claims, 7 Drawing Sheets

PADSTACKS CAPABLE OF RECEIVING DOMES OF DOME KEYPADS IN A PLURALITY OF LOCATIONS AND PRINTED CIRCUIT BOARDS UTILIZING THE PADSTACKS

FIELD

Disclosed are padstack configurations and circuitry, and printed circuit boards utilizing the same that are capable of receiving the dome of a key of a dome keypad in a plurality of locations.

BACKGROUND

Manufacturers of electronic devices strive to limit and reduce the number of required customized parts utilized in the manufacture of their devices. The more commonality of parts between products that can be used in the manufacture of their devices the better the potential for cost savings which can be passed onto consumers. Bringing down the costs of manufacturing, particularly commodities such as mobile communication devices, benefits large segments of society.

Manufactures of electronic devices also strive to distinguish their products from others on the market. For example, different keypad designs may be used for different mobile communication device designs, even those produced by a single manufacturer. Different designs require different printed circuit board configurations to accommodate the placement of feature components.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION

Figure 1:
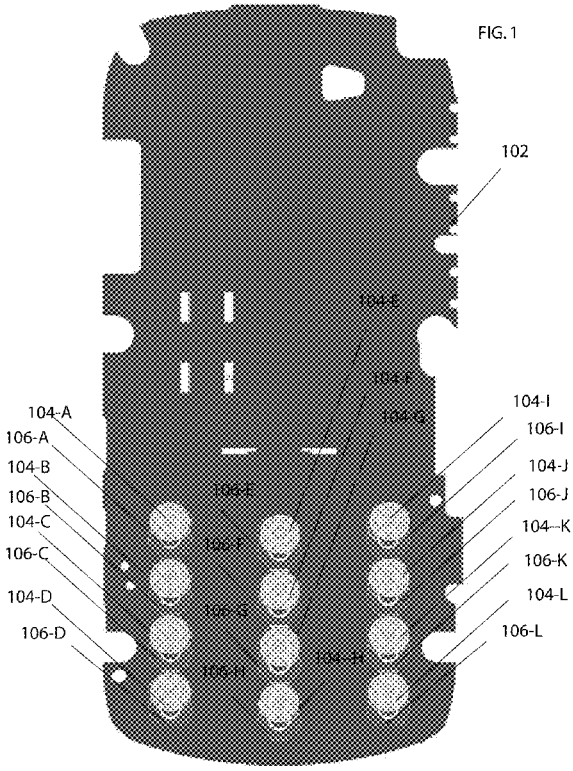
FIG. 1 illustrates an embodiment of printed circuit board depicted with dome locations place that would be placed high on a device.

A printed circuit board designed to receive a dome keypad includes a padstack for each key dome of the keypad. A padstack is the circuit arrangement for a single dome of a keypad. A padstack with a dome switch target and a target ring can receive a single keypad dome. A target ring is in contact with the circumference of a dome of a key of the keypad. A dome switch target can receive the center of a dome when it is depressed by a user utilizing the key of the keypad, to complete the circuit, and send a signal to the controller of the device that the key has been depressed.

It would be beneficial if a keypad printed circuit board design could accommodate a plurality of different keypad designs. The ability to use one printed circuit board design for multiple products, each having a different look in accordance with different keypad dome locations, could reduce cost in the manufacture of a plurality of electronic devices. For example, it would be beneficial if a keypad design with dome locations placed low on the device could utilize the same keypad printed circuit board design as a keypad design with dome locations placed high on the device.

Disclosed is a padstack of a printed circuit board configured for a dome-utilizing keypad configuration, including a dome pad having a plurality of available dome locations. The disclosed padstack has a plurality of dome switch targets and a single circuit configuration shared by the plurality of dome switch targets. In this way, a single padstack is capable of receiving different dome placements. Thus, different keypad designs may utilize the same printed circuit board.

Also disclosed is a printed circuit board configured for a dome-utilizing keypad configuration including an individual padstack having a plurality of dome switch targets and a plurality of target rings capable of accommodating different key dome locations of a dome keypad. The disclosed printed circuit board includes at least one padstack having a single dome switch targets input/output line for the plurality of dome switch targets of the padstack. The disclosed printed circuit board also includes a single target rings input/output line for the plurality of target rings of the padstack. In this way the disclosed printed circuit board includes a single circuit arrangement available for a plurality of different keypad designs.

The instant disclosure is provided to explain in an enabling fashion the best modes of making and using various embodiments in accordance with the present invention. The disclosure is further offered to enhance an understanding and appreciation for the invention principles and advantages thereof, rather than to limit in any manner the invention. While the preferred embodiments of the invention are illustrated and described here, it is clear that the invention is not so limited. Numerous modifications, changes, variations, substitutions, and equivalents will occur to those skilled in the art having the benefit of this disclosure without departing from the spirit and scope of the present invention as defined by the following claims. It is understood that the use of relational terms, if any, such as first and second, up and down, and the like are used solely to distinguish one from another entity or action without necessarily requiring or implying any actual such relationship or order between such entities or actions.

At least some inventive functionality and inventive principles may be implemented with or in software programs or instructions and integrated circuits (ICs) such as application specific ICs. In the interest of brevity and minimization of any risk of obscuring the principles and concepts according to the present invention, discussion of such software and ICs, if any, is limited to the essentials with respect to the principles and concepts within the preferred embodiments.

Figure 2:
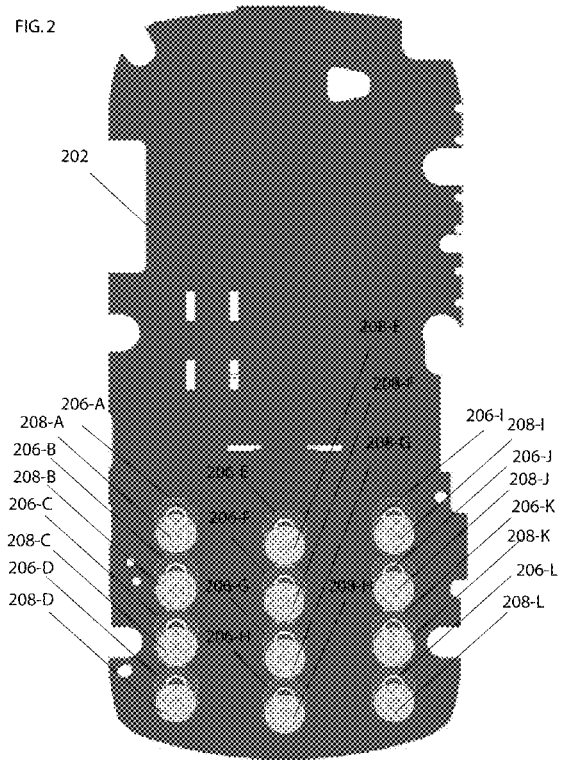
FIG. 2 illustrates an embodiment of a printed circuit board which represents the same printed circuit board as printed circuit board of FIG. 1 but depicted with dome locations place that would be placed low on a device.

FIG. 1 and FIG. 2 depict a printed circuit board with dome keys of a keypad overlaid to illustrate that dome locations placed low on the device could utilize the same keypad design printed circuit board design as a keypad design with dome locations placed high on the device.

FIG. 1 illustrates a printed circuit board 102 depicted with dome locations that would be placed high on a device. Dome keys 104-A, 104-B, 104-C, 104-D, 104-E, 104-F, 104-G, 104-H, 104-I, 104-J, 104-K and 104-L assume a high position on a particular embodiment of the disclosed padstacks 106-A, 106-B, 106-C, 106-D, 106-E, 106-F, 106-G, 106-H, 106-I, 106-J, 106-K and 106-L, visible underneath the dome keys are the padstacks 104-A, 104-B, 104-C, 104-D, 104-E, 104-F, 104-G, 104-H, 104-I, 104-J, 104-K and 104-L.

FIG. 2 illustrates a printed circuit board 202 which represents the same printed circuit board as printed circuit board 102 (see FIG. 1) depicted with dome locations that would be placed low on a device. Dome keys 208-A, 208-B, 208-C, 208-D, 208-E, 208-F, 208-G, 208-H, 208-I, 208-J, 208-K and 208-L assume a low position on a particular embodiment of the disclosed padstacks 206-A, 206-B, 206-C, 206-D, 206-E, 206-F, 206-G, 206-H, 206-I, 206-J, 206-K and 206-L, visible underneath the dome keys are the padstacks 208-A, 208-B, 208-C, 208-D, 208-E, 208-F, 208-G, 208-H, 208-I, 208-J, 208-K and 208-L. Accordingly, the printed circuit board 202 can accommodate a plurality of different keypad designs. As mentioned above, the ability to use one printed circuit board design for multiple products, each having a different look in accordance with different keypad dome locations, could beneficially reduce cost in the manufacture of a plurality of electronic devices.

Figure 3:
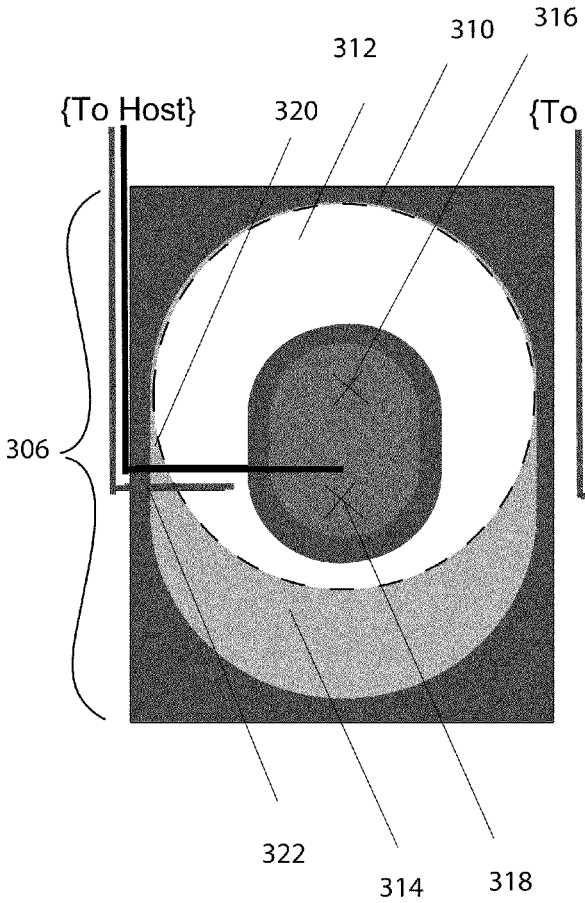
FIG. 3 illustrates a first dome location for an embodiment of the dome switch pad that has elliptical padstack geometry.
Figure 4:
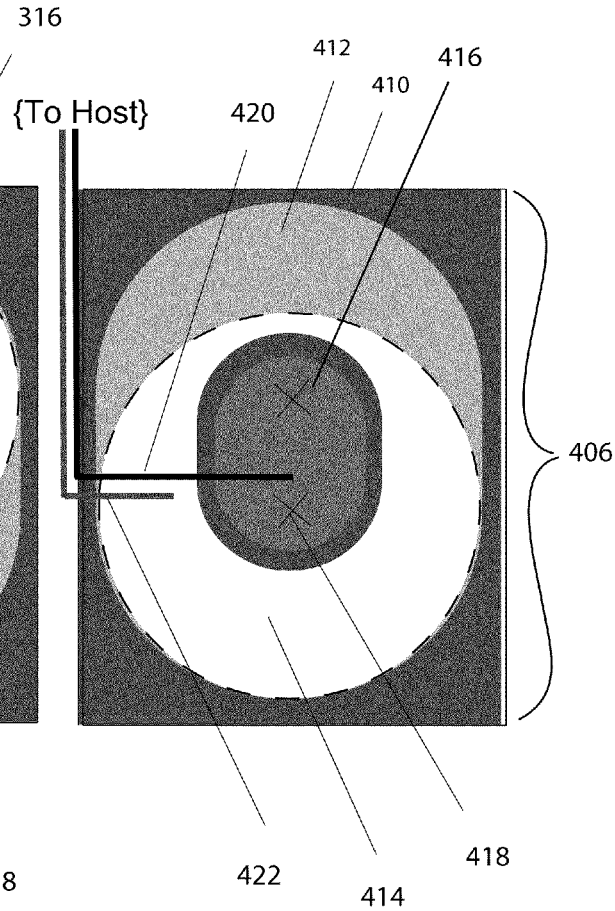
FIG. 4 illustrates a second dome location for an embodiment of the dome switch pad that has elliptical padstack geometry.

FIG. 3 and FIG. 4 illustrate different dome locations for an embodiment of the padstack 306 that has elliptical padstack geometry. FIG. 3 and FIG. 4 differ in the illustration of their respective dome locations. Like elements have been numbered accordingly. Embodiments of different geometries are disclosed below, in particular an embodiment of a complimentary padstack geometry, an embodiment of a conjoined padstack geometry, and embodiment of a dual padstack geometry. It is understood that other geometry configurations are within the scope of this discussion as are corresponding circuit configurations. Different dome sizes and arrangements may dictate which geometry is best. A larger dome provides a better tactile response.

As discussed above, the disclosed padstack 306 of a printed circuit board 202 (see FIG. 2) includes a dome pad 310 having a plurality of available dome locations, the higher dome location 312 which is illustrated by FIG. 3 and the lower dome location 414 (see FIG. 4) which is illustrated by FIG. 4. The dome locations 312 and 414 are superimposed beneath the circuit elements such as dome switch targets (i.e. 316 and 318) for illustrative purposes. A dome would actually sit above the dome switch target.

The disclosed dome pad 310 has a plurality of dome switch targets 316 and 318 and a single circuit configuration 320 shared by the plurality of dome switch targets 316 and 318. The dome switch target 316 is for dome location 312 and the dome switch target 318 is for dome location 314 of FIG. 3. The dome switch target 418 is for dome location 414 and the dome switch target 416 is for dome location 412 of FIG. 4. Referring to FIG. 3, the dome switch target 316 and 318 share a single circuit 320. The dome locations, or target rings 312 and 314 share a single circuit 322. Referring to FIG. 4, the dome switch target 416 and 418 share a single circuit 420. The dome locations, or target rings 412 and 414 share a single circuit 422.

Referring to FIG. 3, a target ring, either target ring 312 or 314 is in constant contact with at least a portion of the circumference of a dome of a key of the keypad. Either dome switch target 316 or 318, depending upon the dome location, can receive the center of a dome when it is depressed by a user utilizing the key of the keypad, to complete the circuit and send a signal to the controller of the device that the key has been depressed. Thus, different keypad designs may utilize the same printed circuit board.

Figure 5:
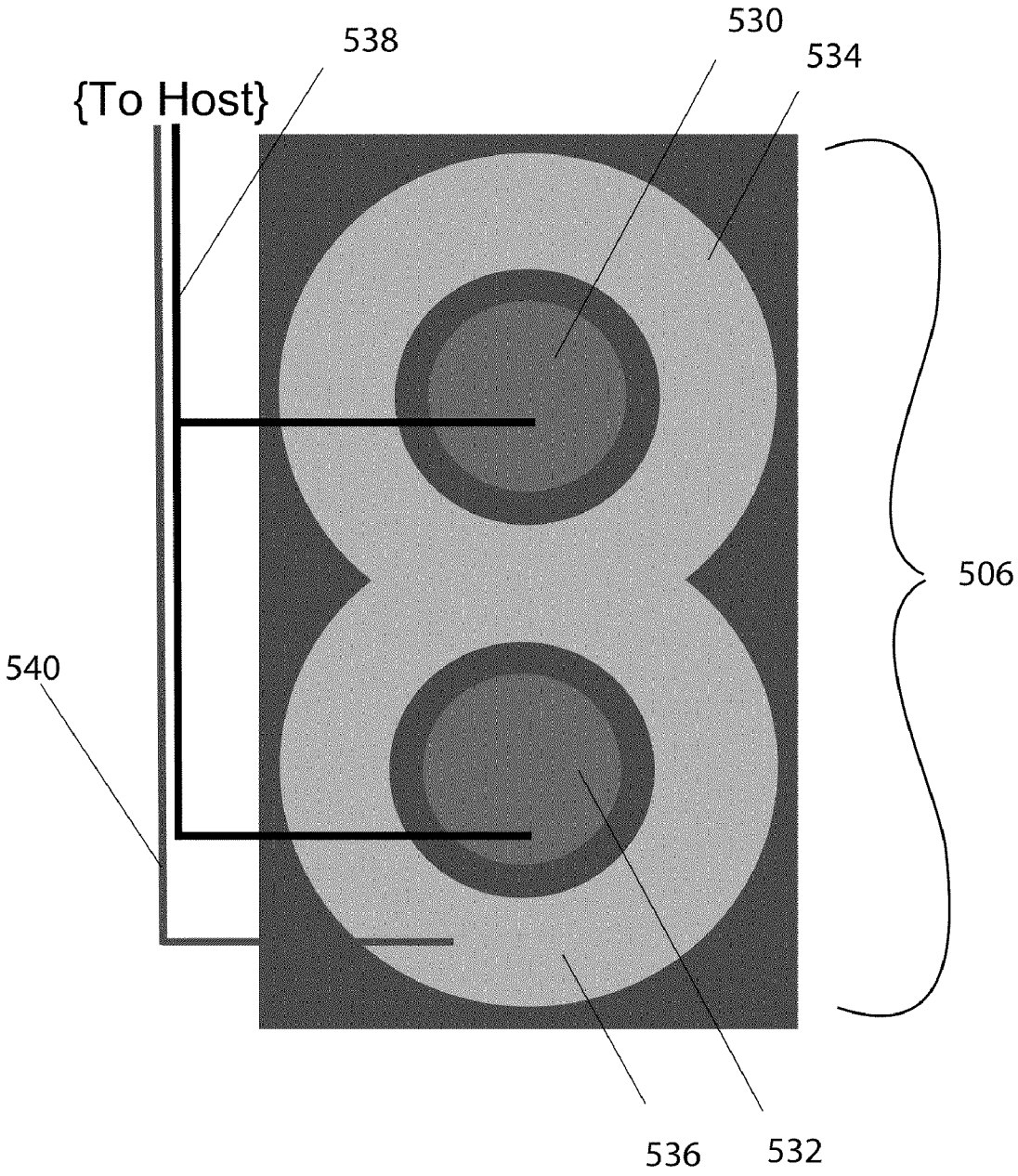
FIG. 5 illustrates an embodiment of a padstack having a conjoined geometry.

FIG. 5 illustrates an embodiment of a padstack having a conjoined geometry. The disclosed padstack having a conjoined geometry has a plurality of dome switch targets 530 and 532 and a plurality of target rings 534 and 536 capable of accommodating different key dome locations of a dome keypad. The disclosed padstack 506 includes a single dome switch targets input/output line 538 for the plurality of dome switch targets 530 and 532. The disclosed padstack 506 also includes a single target rings input/output line 540 for the plurality of target rings 534 and 536. In this way the disclosed printed circuit board 102 (see FIG. 1) includes a single circuit arrangement available for a plurality of different keypad designs.

Figure 6:
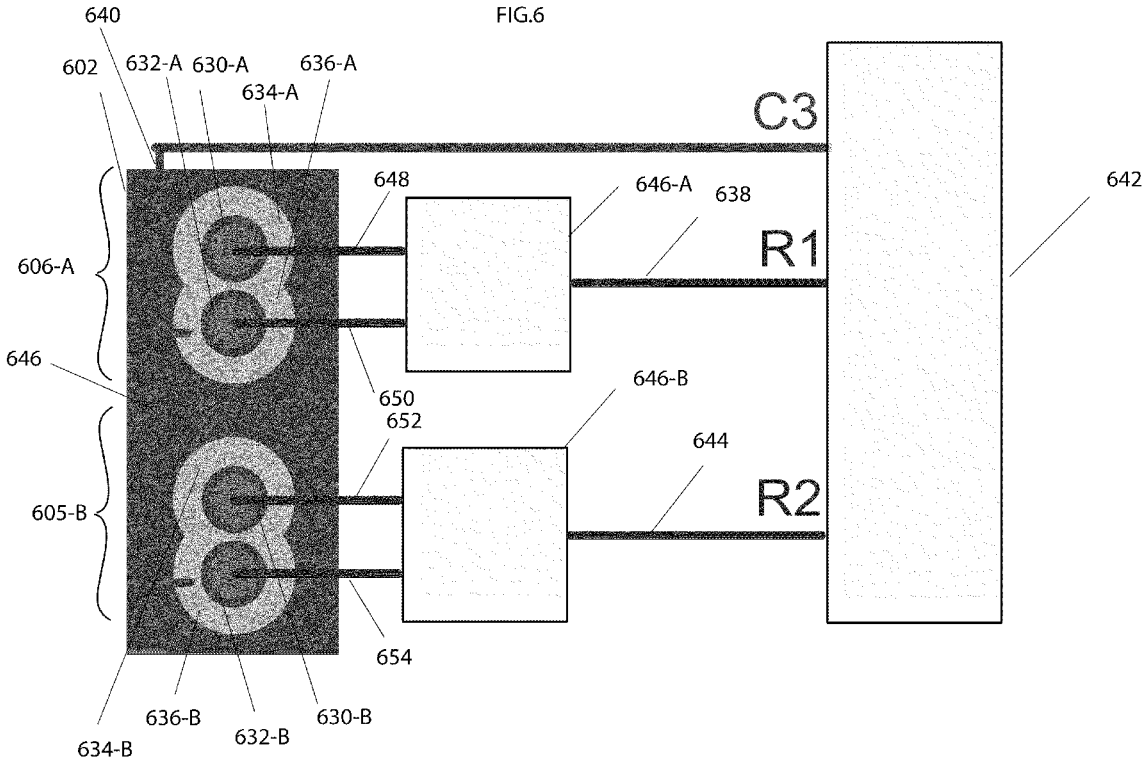
FIG. 6 illustrates a circuitry embodiment for two padstacks, each having a conjoined geometry on a printed circuit board.

FIG. 6 illustrates a circuitry embodiment for two padstacks 606-A and 606-B, each having a conjoined geometry on a printed circuit board 602. The circuitry involves a multiplexer 646-A for padstack 606-A coupled by lines 648 and 650. Similar to the padstack 506 (see FIG. 5), the disclosed padstacks 606-A of FIG. 6 having a conjoined geometry have a plurality of dome switch targets 630-A and 632-A and a plurality of target rings 634-A and 636-A capable of accommodating different key dome locations of a keypad design. The disclosed padstack 606-A includes a single dome switch targets input/output line 638 for the plurality of dome switch targets 630-A and 632-A of the padstack 606-A. The disclosed padstack 606-A also includes a single target rings input/output line 640 for the plurality of target rings 634-A and 636-A of the individual padstack 602-A. The single dome switch targets input/output line 638 and single target rings input/output line 640 are in communication with the host 642. In this way the disclosed printed circuit board 602 includes a single circuit arrangement available for a plurality of different key pad designs.

FIG. 6 further illustrates the disclosed padstack 606-B having a conjoined geometry have a plurality of dome switch targets 630-B and 632-B and a plurality of target rings 634-B and 636-B capable of accommodating different key dome locations of a keypad design. The circuitry involves a multiplexer 646-B for padstack 606-B coupled by lines 652 and 654. The disclosed padstack 606-B includes a single dome switch targets input/output line 644 for the plurality of dome switch targets 630-B and 632-B of the padstack 606-B. The disclosed padstack 606-B also includes a single target rings input/output line 646 for the plurality of target rings 634-B and 636-B of the individual padstack 602-B. The single dome switch targets input/output line 644 and single target rings input/output line 646 are in communication with the host 642. In this way the disclosed printed circuit board 602 includes a single circuit arrangement available for a plurality of different key pad designs.

Figure 7:
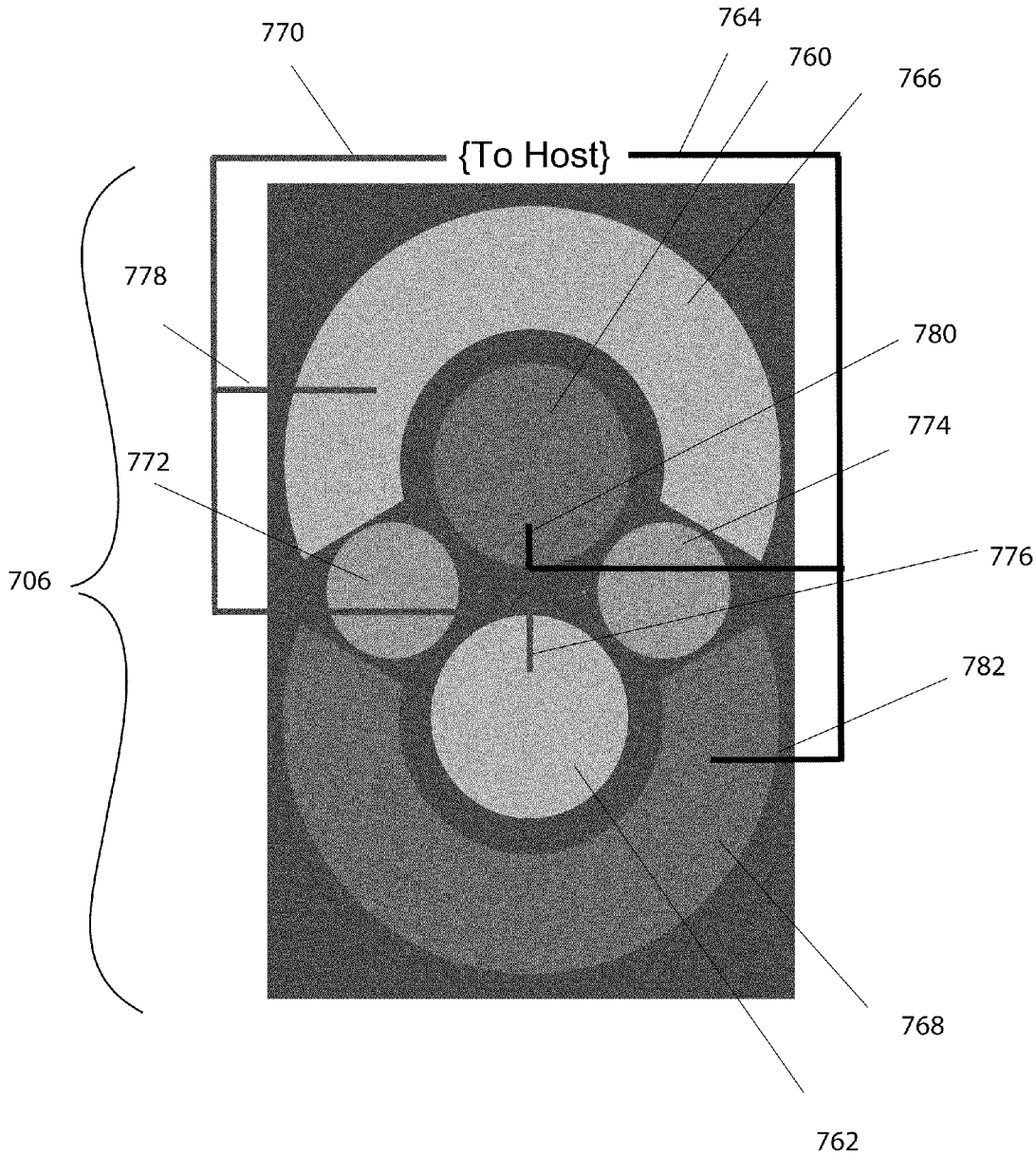
FIG. 7 illustrates an embodiment of a padstack having a keypad padstack complementary geometry.

FIG. 7 illustrates an embodiment of a padstack 702 having a keypad padstack complementary geometry having a plurality of available dome locations. The disclosed padstack 702 has a plurality of dome switch targets 760 and 762. Moreover, the disclosed padstack 706 has a plurality of dome locations or ring targets 766 and 768. When a dome location is the upper target ring 766 having circuitry 778, the switch target 760 circuitry is 780. When a dome location is the lower target 768 having circuitry 782, the switch target 762 circuitry is 776. In this embodiment, an input/output line for a first dome switch target is the input/output line for a target ring of a second dome switch target. That is, the single circuit configuration 764 is shared by the dome switch target 760 and ring target 768. Moreover, the single circuit configuration 770 is shared by the dome switch target 762 and ring target 766. The unconnected dummy regions 772 and 774 can be used to bridge a gap a dome circumference position. As with the other disclosed geometries, the disclosed padstack 706 includes a single circuit arrangement available for a plurality of different key pad designs.

Figure 8:
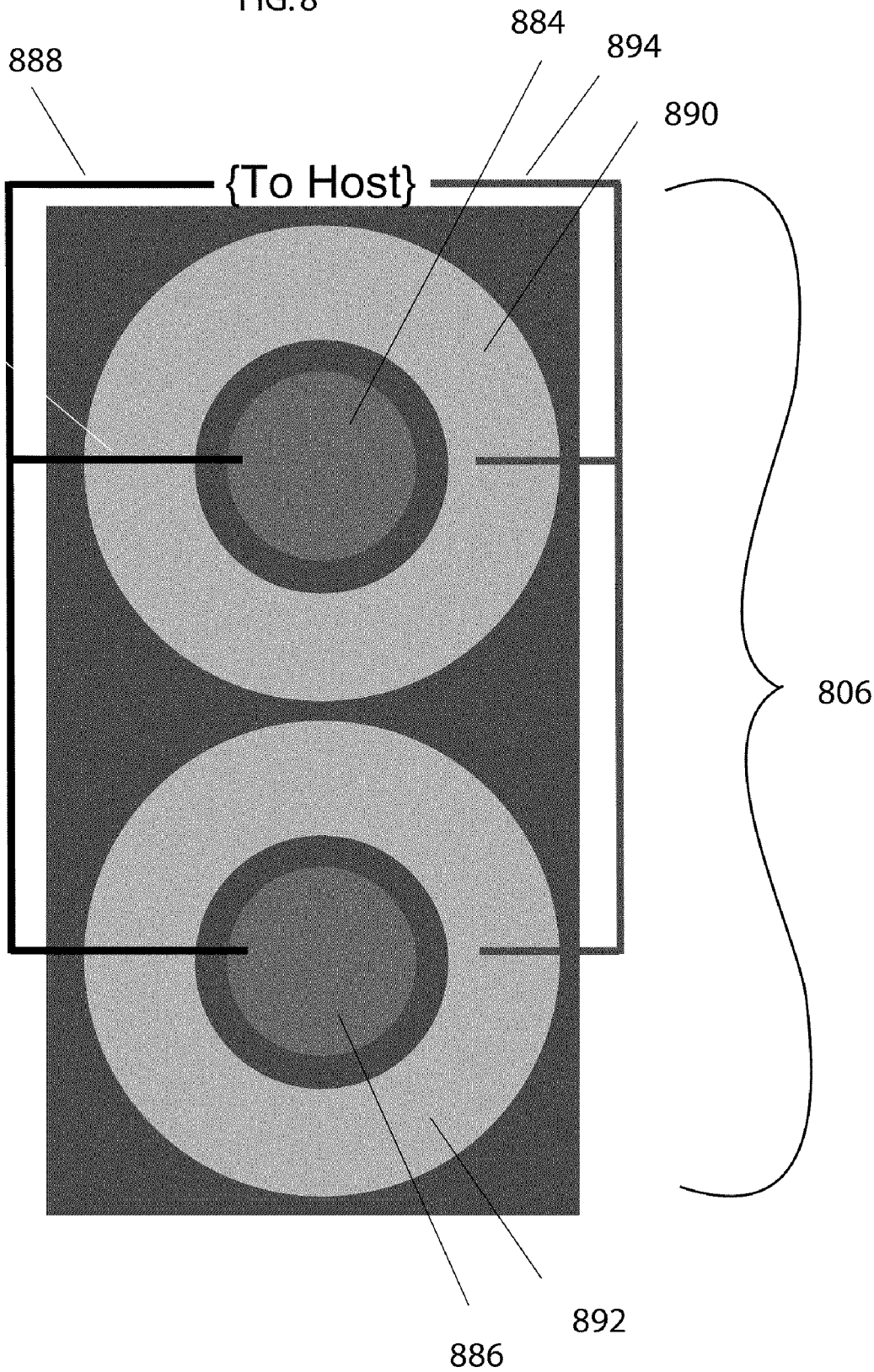
FIG. 8 illustrates an embodiment of a padstack having a keypad dual padstack geometry.

FIG. 8 illustrates an embodiment of a padstack 806 having a dual padstack geometry having a plurality of available dome locations. The disclosed padstack 806 has a plurality of dome switch targets 884 and 886 and a single circuit configuration 888 shared by the plurality of dome switch targets 884 and 886. Moreover, the disclosed padstack 806 has a plurality of target rings 890 and 892 and a single circuit configuration 894 shared by the plurality of target rings 890 and 892. In this way, a single padstack is capable of receiving different dome placements.

Figure 9:
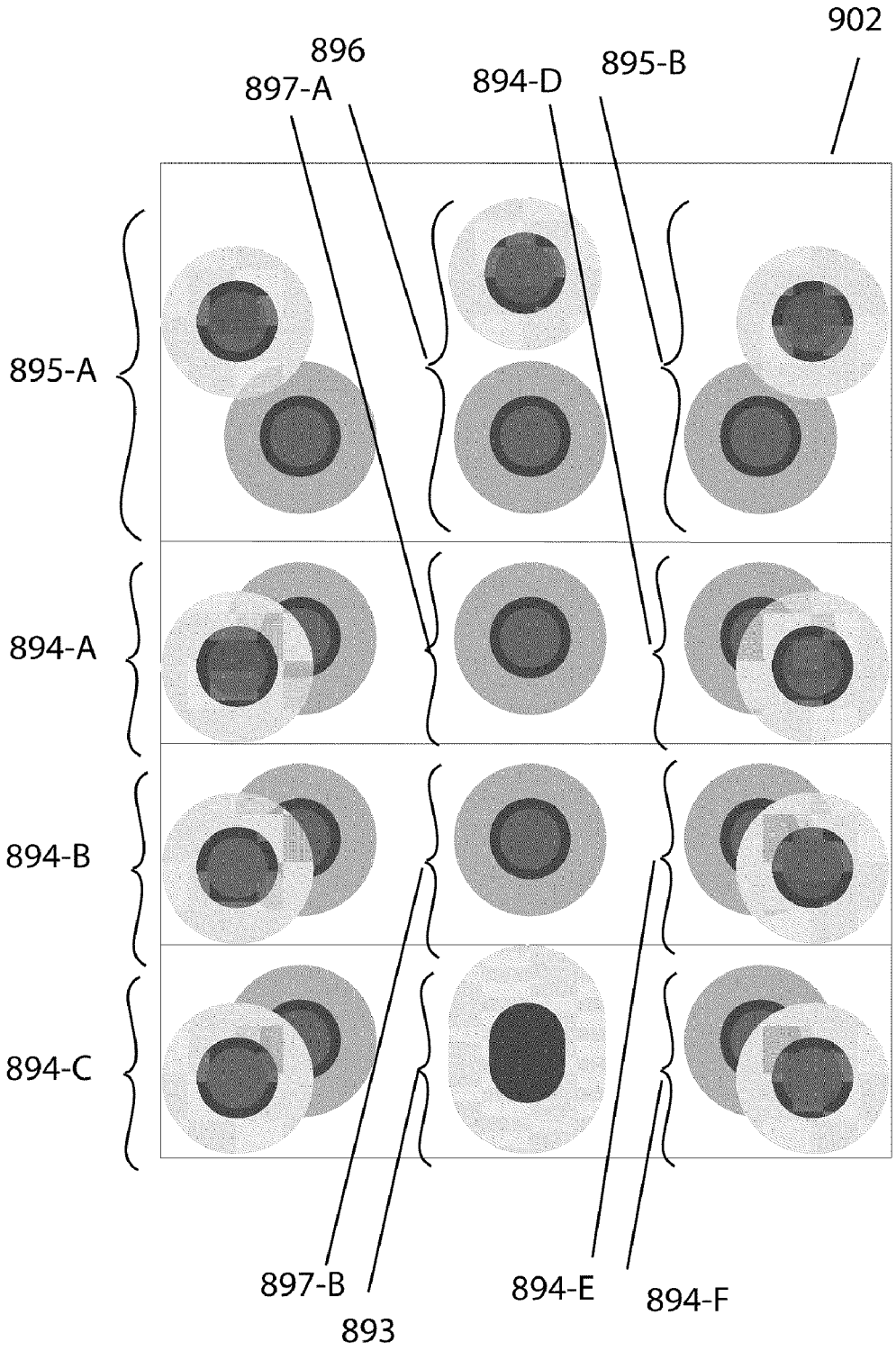
FIG. 9 illustrates an embodiment of a printed circuit board configured for a plurality of dome utilizing keypad configurations including a plurality of padstacks, at least some of which including a plurality of dome switch targets and a plurality of target rings.

FIG. 9 illustrates an embodiment of a printed circuit board 902 configured for a plurality of dome-utilizing keypad configurations including a plurality of padstacks, at least some of which including a plurality of dome switch targets and a plurality of target rings. An elliptical padstack geometry element 893 is depicted. Complementary padstack geometry elements 894-A, 894-B, 894-C, 894-D, 894-E and 894-F are depicted. Conjoined padstack geometry elements 895-A and 895-B are depicted. A dual padstack geometry element 896 is depicted. Padstack elements 897-A and 897-B having a single dome switch target and a single target ring are depicted. Accordingly, the printed circuit board is configured to cooperate with one of a plurality of different dome utilizing keypad configurations based on enabled particular electrical connections of the printed circuit board depending on utilized dome switch targets and utilized target rings. As mentioned, the printed circuit board may also include one or more padstacks having a single dome switch target and a single target ring.

The disclosed keypad printed circuit board design may accommodate a plurality of different keypad designs. The ability to use one printed circuit board design for multiple products, each having a different look in accordance with different keypad dome locations, could reduce cost in the manufacture of a plurality of electronic devices. Depending upon the arrangement of different types of padstack geometries, dome key locations of a plurality of different keypad designs may beneficially cooperate with a single printed circuit board.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) was chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally and equitably entitled.

The invention claimed is:

1. A padstack of a printed circuit board configured for a dome utilizing keypad configuration, comprising:

a dome pad including a plurality of available dome locations, the dome pad having a plurality of dome switch targets; and a single circuit configuration shared by the plurality of dome switch targets.

2. The padstack of claim 1, comprising:

a single dome switch targets input/output line for the plurality of dome switch targets.

3. The padstack of claim 1, wherein the dome pad further comprises:

a plurality target rings.

4. The printed circuit board of claim 3, comprising:

a single target rings input/output line for the plurality of target rings.

5. The padstack of claim 1, wherein a geometry of the dome switch pad is an elliptical padstack geometry.

6. The padstack of claim 1, wherein a geometry of the dome switch pad is a complimentary padstack geometry.

7. The padstack of claim 1, wherein a geometry of the dome switch pad is a conjoined padstack geometry.

8. The padstack of claim 1, wherein a geometry of the dome switch pad is a dual padstack geometry.

9. The printed circuit board of claim 1 further comprising:

a padstack having a single dome switch target and a single target ring.

10. A printed circuit board configured for a dome-utilizing keypad configuration, comprising;

an individual padstack having a plurality of dome switch targets and a plurality of target rings;

a single dome switch targets input/output line for the plurality of dome switch targets; and a single target rings input/output line for the plurality of target rings.

11. The printed circuit board of claim 10 wherein at least for one padstack, an input/output line for a first dome switch target is the input/output line for a single target ring of a second dome switch target.

12. The padstack of claim 11, wherein a geometry of the dome switch pad is an elliptical padstack geometry.

13. The padstack of claim 10, wherein a geometry of the dome switch pad is a complimentary padstack geometry.

14. The padstack of claim 10, wherein a geometry of the dome switch pad is a conjoined padstack geometry.

15. The padstack of claim 10, wherein a geometry of the dome switch pad is a dual padstack geometry.

16. A printed circuit board having electrical connections, the printed circuit board configured for a plurality of dome utilizing keypad configurations, comprising:

a plurality of padstacks, at least some of which including a plurality of dome switch targets and a plurality of target rings;

wherein the printed circuit board is configured to cooperate with one of a plurality of different dome utilizing keypad configurations thereon based on enabled particular electrical connections of the printed circuit board depending on utilized dome switch targets and utilized target rings.

17. A padstack of claim 16, wherein a geometry of the padstack is an elliptical padstack geometry.

18. A padstack of claim 16, wherein a geometry of the padstack is a complimentary padstack geometry.

19. A padstack of claim 16, wherein a geometry of the padstack is a conjoined padstack geometry.

20. A padstack of claim 16, wherein a geometry of the padstack is a dual padstack geometry.

* * * * *